US008642869B2

(12) United States Patent
Prefontaine

(10) Patent No.: US 8,642,869 B2
(45) Date of Patent: Feb. 4, 2014

(54) SOUND REDUCTION ENCLOSURE FOR HI-HAT CYMBALS

(76) Inventor: Luc Prefontaine, Montreal (CA)

( * ) Notice: Subject to any disclaimer, the term of this patent is extended or adjusted under 35 U.S.C. 154(b) by 0 days.

(21) Appl. No.: 13/210,640

(22) Filed: Aug. 16, 2011

(65) Prior Publication Data

US 2013/0255471 A1 Oct. 3, 2013

(51) Int. Cl.
*G10D 13/02* (2006.01)

(52) U.S. Cl.
USPC ..... 84/422.3; 181/30

(58) Field of Classification Search
USPC ..... 84/422.3; 181/30
See application file for complete search history.

(56) References Cited

U.S. PATENT DOCUMENTS

| | | | | | |
|---|---|---|---|---|---|
| 501,318 | A | * | 7/1893 | Boulanger | 206/314 |
| 2,601,426 | A | * | 6/1952 | Baumann | 206/349 |
| 3,517,468 | A | * | 6/1970 | Woods | 52/79.1 |
| D232,735 | S | * | 9/1974 | Kinsey et al. | D14/365 |
| 4,037,509 | A | * | 7/1977 | Slomovits | 84/422.3 |
| 4,111,095 | A | * | 9/1978 | Simons | 84/422.3 |
| 4,120,376 | A | * | 10/1978 | Palmer | 181/204 |
| 4,177,709 | A | * | 12/1979 | Adams | 84/422.3 |
| 4,290,332 | A | * | 9/1981 | Schoeffling, Jr. | 84/723 |
| 4,515,238 | A | * | 5/1985 | Baker | 181/30 |
| D283,464 | S | * | 4/1986 | Ogden | D3/204 |
| 5,088,377 | A | * | 2/1992 | Delecaris | 84/422.3 |
| 5,123,874 | A | * | 6/1992 | White, III | 454/251 |
| 5,922,980 | A | * | 7/1999 | Arteaga | 84/411 M |
| 6,305,492 | B1 | * | 10/2001 | Oleiko et al. | 181/210 |
| 6,448,482 | B2 | * | 9/2002 | Cerro | 84/422.3 |
| 7,282,633 | B1 | * | 10/2007 | Coolidge | 84/723 |
| 7,368,649 | B2 | * | 5/2008 | Mintz | 84/402 |
| D585,639 | S | * | 2/2009 | Taninbaum et al. | D3/204 |
| 7,665,604 | B2 | * | 2/2010 | Taninbaum | 206/314 |
| D613,940 | S | * | 4/2010 | Colwell | D3/204 |
| 8,083,023 | B1 | * | 12/2011 | Perdue et al. | 181/198 |
| 2007/0163424 | A1 | * | 7/2007 | Mintz | 84/422.3 |
| 2010/0024624 | A1 | * | 2/2010 | Wachter | 84/422.3 |

* cited by examiner

*Primary Examiner* — Robert W Horn

(57) ABSTRACT

The invention provides a sound reduction enclosure for hi-hat cymbal assemblies, enclosure which can be fastened directly to the hi-hat stand to greatly reduce sound leakage and offer more precise control of sound emissions during recording sessions and live performances. The enclosure is made up of two (2) primary elements:

1—the main, funnel-shaped body that attaches to the hi-hat stand and surrounds the cymbal assembly, containing and allowing control of the sound;

2—the different lids that provide yet greater sound reduction and control.

With or without its lid, the invention allows the user to both:

1—activate the hi-hat cymbals using the pedal;

2—strike the hi-hat cymbals using the drumsticks.

5 Claims, 4 Drawing Sheets

SOUND REDUCTION ENCLOSURE FOR HI-HAT CYMBALS

The invention provides a sound reduction enclosure for hi-hat cymbal assemblies.

BACKGROUND OF THE INVENTION

For as long as musicians, sound technicians and engineers have been trying to record and amplify music, hi-hat cymbals have always presented a problem known as "hi-hat bleeding". Hi-hat bleeding is the spilling over of the sound generated by the hi-hat cymbals into the microphones of the other elements of the drum kit. The very nature of the sound waves (high-frequency) coming from the hi-hat as well as the proximity of the hi-hat assembly to the snare drum result in the unwanted sound of the hi-hat cymbal leaking into other audio channels via their microphones. No electronic countermeasure, no physical barrier, no sound-recording technique has so far provided a solution to the "hi-hat bleeding" problem.

To date, the only costly and time-consuming solution is to record the drums without the hi-hat cymbal, then record the hi-hat separately.

The need for a solution to this problem still fuels discussions between sound engineers, recording engineers and musicians.

SUMMARY OF THE INVENTION

Considered broadly, a hi-hat cymbal assembly consists of two cymbals that are mounted on a stand, one on top of the other, and clashed together using a pedal on the stand. A narrow metal shaft or rod runs through both cymbals into a hollow tube and connects to the pedal. The top cymbal is connected to the rod with a clutch, while the bottom cymbal remains stationary resting on the hollow tube.

The invention consists of a main shell (lower part) and the lids (upper part). The main shell clasps onto the hi-hat stand, surrounding the hi-hat cymbals without impeding their use; the lid section clasps onto the main shell.

The main shell is flared and funnel-shaped, with an upper lip that cups around the hi-hat cymbals without touching them. A lateral opening in the lip allows the user to strike the cymbals.

The lid section clasps over the main shell and offers an opening that matches that of the main shell lip to allow the user to strike the cymbals.

DRAWINGS

Figure 4:
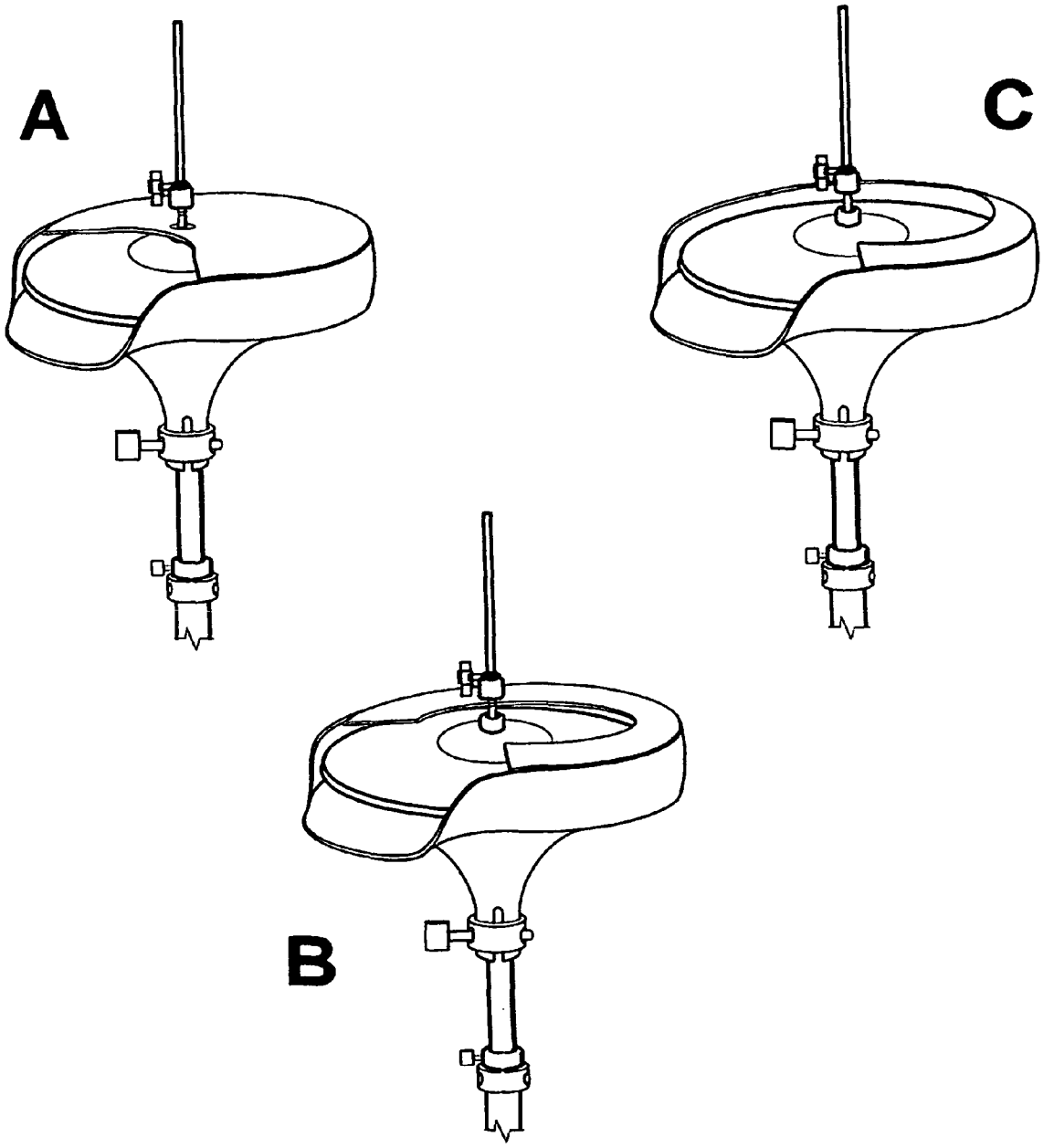

FIG. 4, panels A, B and C, is a view of three (3) types of apparatus lids:

a—Full-containment
b—Regular containment
c—Minimal containment

Figure 1:
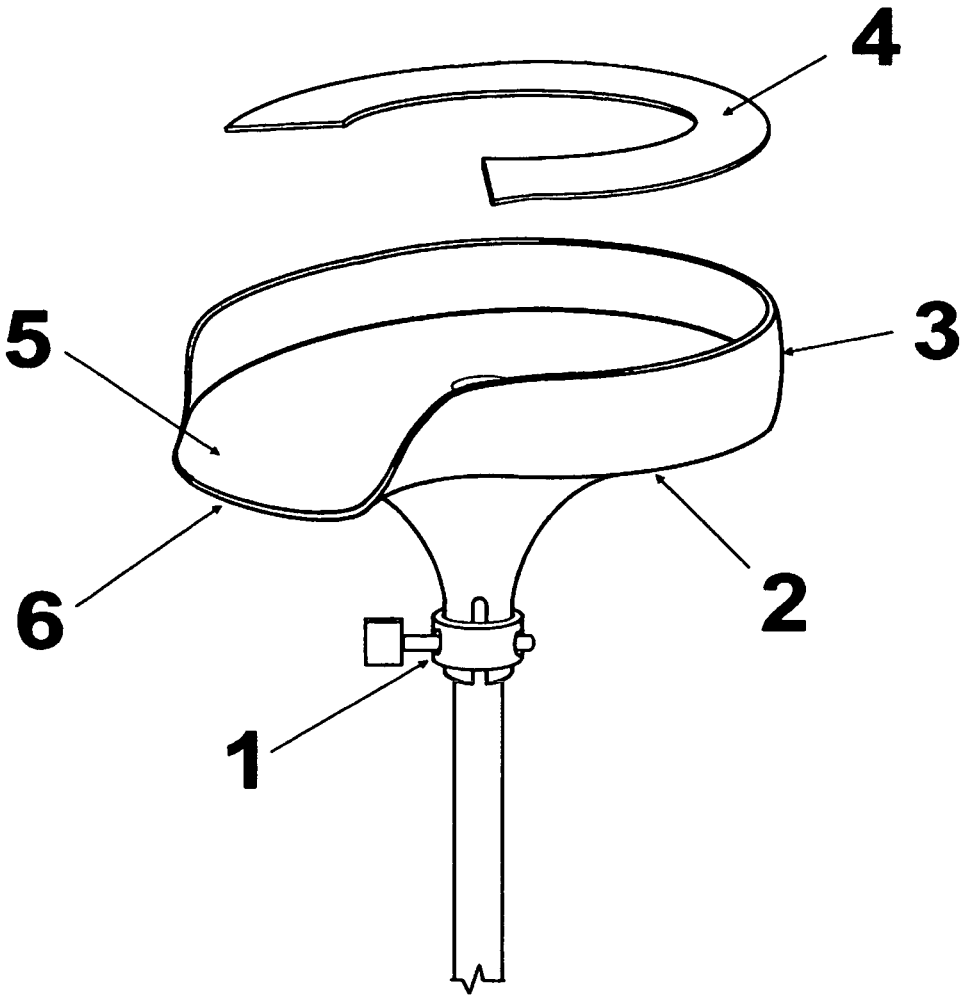
FIG. 1 is a view of the basic apparatus (main shell and one of its complementary lids).
Figure 2A:
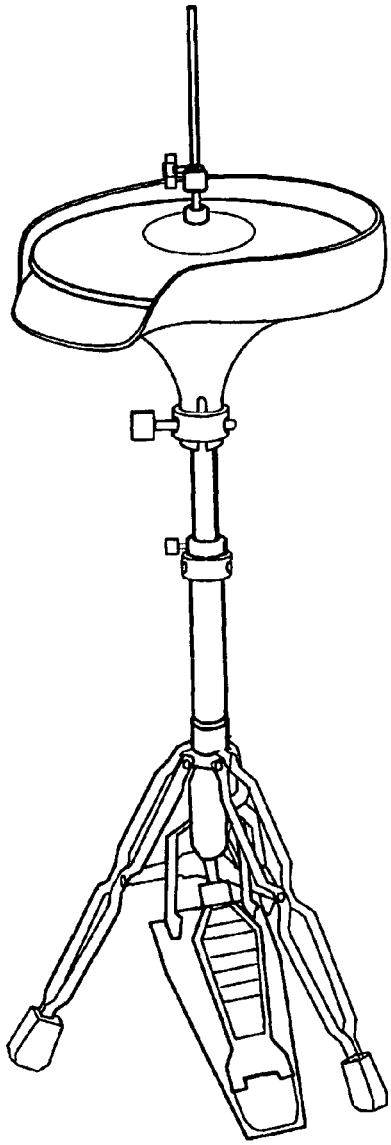
FIG. 2A is a view of the basic apparatus, without a lid, installed on a hi-hat.
Figure 2B:
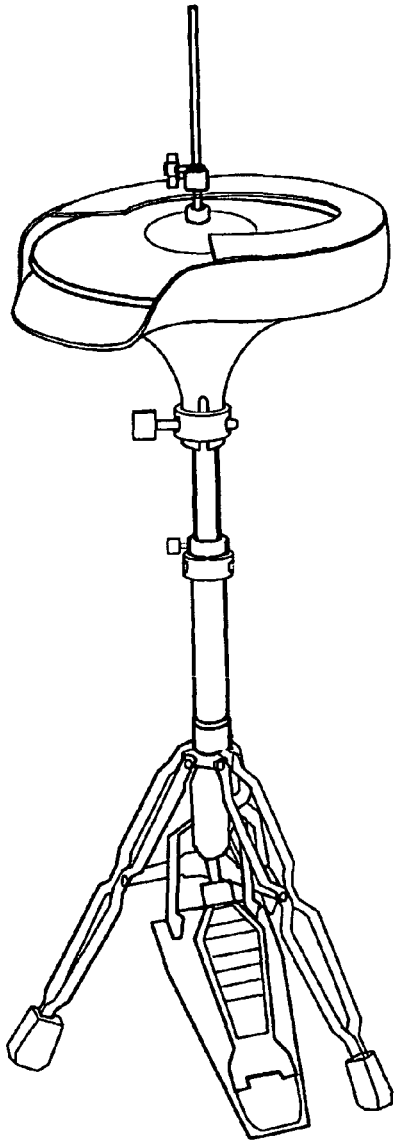
FIG. 2B is a view of the basic apparatus, with a lid, installed on a hi-hat.
Figure 3:
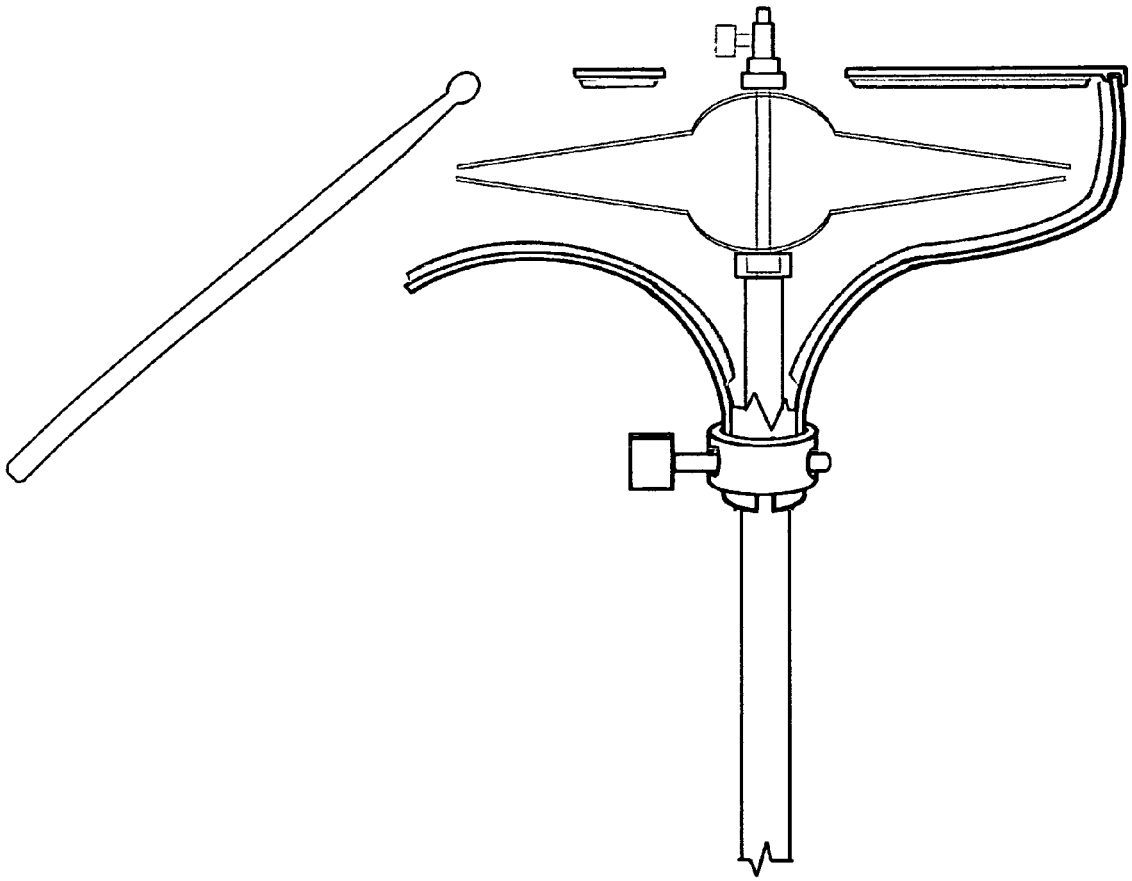
FIG. 3 is a cross-sectional view of the apparatus, with full-containment lid, installed on a hi-hat. The drawing illustrates the cupping lip concept of the apparatus.

As seen in FIG. 1:

1. the vertical hi-hat stand onto which the apparatus is fastened
2. the funnel-shaped apparatus cupping around the hi-hat cymbals
3. the vertical lip of the main shell
4. the complementary lid that can be attached to the apparatus
5. the opening in the main shell lip allowing user to strike the cymbals
6. the downward lip containing sound.

DETAILED DESCRIPTION

The invention, illustrated in FIGS. 1, 2A, 2B, 3 and 4, panels A, B and C, consists of a main shell, made from plastic or other similar materials, and lids of different shapes and sizes. Once attached to a hi-hat cymbal stand, the shell and lid surround the hi-hat cymbals, containing the sound without physical contact with the cymbals and without impeding their use in any way. The inside of the apparatus is lined with a soundproofing material. The apparatus offers a lateral opening in the shell and lids allowing the user to strike the cymbals with drumsticks. On the main shell, the lateral opening flares out downwards to further contain sound when the cymbals are struck.

When in a recording session or on stage, the high-pitched sound of the hi-hat creates a problem commonly referred to as "hi-hat bleeding". Hi-hat bleeding is the unwanted infiltration of the hi-hat sounds into the other microphones used to amplify or record all the other components of a drum kit.

The main shell and lid of the invention capture and channel the sounds of the hi-hat thus providing an effective solution to hi-hat bleeding.

The embodiments of the invention in which an exclusive property or privilege is claimed are defined as follows:

1. A sound reducing enclosure for a hi-hat, said hi-hat including a stand and a pair of cymbals mounted to said stand in a substantially parallel relationship relative to each other, said cymbals each defining a respective cymbal peripheral edge, said sound reducing enclosure comprising:

an attachment for attaching said sound reducing enclosure to said stand;

a lip positioned adjacent part of said cymbal peripheral edges when said sound reducing enclosure is operatively mounted to said stand; and a spacing portion extending between said attachment and said lip.

2. A sound reducing enclosure as defined in claim 1, wherein said lip extends along an arcsegment only partially surrounding said cymbal peripheral edges.

3. A sound reducing enclosure as defined in claim 1, further comprising lid a mountable to said lip opposed to said spacing portion.

4. A sound reducing enclosure as defined in claim 1, wherein said spacing portion is substantially frusto-conical.

5. A sound reducing enclosure as defined in claim 1, wherein said lip defines a circumferentially extending gap, said sound reducing enclosure including an auxiliary lip extending downwardly in register with said gap.

* * * * *